United States Patent [19]

Schnell

[11] 4,023,861

[45] May 17, 1977

[54] METHOD AND APPARATUS FOR CONTROLLING A TUNNELING MACHINE

[75] Inventor: Günter Schnell, Bochum, Germany

[73] Assignee: Gebr. Eickhoff, Maschinenfabrik und Eisengiesserei m.b.H., Bochum, Germany

[22] Filed: Nov. 21, 1975

[21] Appl. No.: 634,163

[30] Foreign Application Priority Data

Dec. 11, 1974 Germany ..... 2458514

[52] U.S. Cl. ..... 299/1; 299/75

[51] Int. Cl.² ..... E21D 9/10

[58] Field of Search ..... 299/1

[56] References Cited

UNITED STATES PATENTS

| | | | |
|---|---|---|---|
| 3,321,248 | 5/1967 | Williamson et al. | 299/1 |
| 3,482,103 | 12/1969 | Martinsen | 299/1 X |
| 3,517,966 | 6/1970 | Montacie | 299/1 |
| 3,560,753 | 2/1971 | Beug et al. | 299/1 X |

FOREIGN PATENTS OR APPLICATIONS

| | | | |
|---|---|---|---|
| 1,955,866 | 1/1973 | Germany | 299/1 |
| 1,340,772 | 12/1973 | United Kingdom | 299/1 |

*Primary Examiner*—Ernest R. Purser
*Attorney, Agent, or Firm*—Brown, Murray, Flick & Peckham

[57] ABSTRACT

The range of movement by a winning tool of a tunneling machine is controlled to release material from a heading wall to form a tunnel having a desired profile. The tunneling machine carries gyroscope detectors and a detector for a laser beam which is projected along a desired tunnel heading. Such detectors provide electrical signals corresponding to a position change of the tunneling machine. Position transducers, coupled with counters, provide electrical signals corresponding to perpendicular position coordinates of the winning tool with respect to the tunneling machine. Means, including a computer, receive these electrical signals and continuously compute a limit coordinate signal based on a desired tunnel profile provided by a computer program. The limit coordinate signal corresponds to a measure of the distance, at the heading face of the tunnel, lying perpendicularly between the course of displacement by the winning tool and a required point on the track of movement by the winning tool to cut the heading face at a tangent to the desired profile of the tunnel. Servo valves for the fluid actuators used to position the winning tool are responsive to the limit coordinate signal which is continuously compared with the measured coordinate signal to prevent movement of the winning tool beyond the desired profile of the tunnel. The winning tool follows a course of travel which is either linear or parallel to the desired tunnel cross section.

8 Claims, 5 Drawing Figures

X
Y
$Y_{1ST3}$
$Y_{1ST2}$
$Y_{1ST1}$
$A_1$
$A_2$
$A_3$
P1
P2
P3
4
2
11
26
$X_{1ST1}$
$X_{LIMIT-1}$
$X_{LIMIT-2}$
$X_{LIMIT-3}$

METHOD AND APPARATUS FOR CONTROLLING A TUNNELING MACHINE

BACKGROUND OF THE INVENTION

This invention relates to a method and apparatus for controlling the displacement of a winning tool by a support arm adapted for universal movement while supported by the frame of a tunneling machine employed to release material from the heading face and form a tunnel having a desired profile. More particularly, the present invention relates to such a tunneling machine wherein the range of movement by the winning tool is limited to a desired tunnel profile in relation to a laser beam projecting along a desired tunnel heading and wherein the tunneling machine includes detector means for generating signals which are proportional to deviations and/or offsets of the tunneling machine to control the range of movement by the winning tool.

It is possible to limit the traversing motion of a winning tool while supported for universal pivotal movement on a support arm of a tunneling machine. The traversing motion of a winning tool must be limited so as to cut only a desired tunnel cross section along a desired tunnel heading. One suggestion was to use set-point values to the coordinates of the winning tool. The coordinates are in the form of signals produced by using a light-reflective barrier to scan a template or pattern which defines a geometrical outline that is similar to the desired tunnel profile. The signals corresponding to the set-point values are corrected by other signals corresponding to deviations of the tunneling machine from a set-point position. The correcting signals actually correspond to position deviations of the tunneling machine and/or translating movements by a receiver for a laser beam. The signals corresponding to the set-point values of the coordinates are corrected not only by signals corresponding to deviations of the tunneling machine but also by rotation of the template. One or more of the correcting signals have a magnitude which is equal but opposite to the translating motion required to align the receiver with the laser beam. In this way, the range of movement by the winning tool remains at the set-point position as defined by the laser beam. In this control system, the laser receiver or parts thereof are aligned by detecting the laser beam while the template is aligned by gravity only.

It has also been proposed to control a tunneling machine having a winning tool supported for universal movement by a support arm through the use of two gyroscopic systems both of which are situated in cross-sectional planes of the roadway in which the heading of the tunnel is to proceed. The gyroscopic systems are associated with devices to form signals proportional to the angular deviations and displacements to the position of the tunneling machine. These signals are used to correct the measured values to the coordinates of the winning tool. A template, similar to the desired tunnel cross section, is traced by a reflective-light barrier and a reciever surface to provide corresponding electrical signals. A final control device is driven in response to the signals from the receiver surface to slide and rotate both the template within its plane and the control device for the light barrier. In this system, the two gyroscopic systems detect the angular deviations of the tunneling machine and correct the measured coordinates of the winning tool. The receiver surface is used to detect parallel deviations of the tunneling machine and slidably displace the template together with the final control device for the light-reflective barrier. However, the gyroscopic systems also detect offsets of the tunneling machine in cooperation with the receiver surface so that such offsets are corrected by rotation of the template.

SUMMARY OF THE INVENTION

It is an object of the present invention to provide a control system and method for limiting the range of movement by a winning tool of a tunneling machine to a desired tunnel profile along a tunnel heading which is defined in relation to a laser beam without the employment of a template, pattern or similar device to define the desired tunnel profile.

More specifically, the present invention provides a control system for controlling the displacement of the winning tool by a support arm adapted for universal movement while supported by the frame of a tunneling machine employed to form a tunnel with a desired profile, the control system including the combination of means for projecting a laser beam in a direction along a desired tunnel heading toward the tunneling machine while the winning tool thereof is arranged to release material from the heading face of the tunnel, means including a laser beam detector on the tunneling machine for generating first signals corresponding to a position change of the tunneling machine with respect to the laser beam, means for generating second and third signals corresponding to perpendicular position coordinates of the winning tool with respect to the tunneling machine, means responsive to the first and second signals to continuously compute a limit coordinate signal which corresponds to a measure of the distance lying perpendicularly between an intersection with the winning tool as defined by an intersection with one of the perpendicular coordinates and a point on the track of movement by the winning tool when cutting the heading face at a tangent to the desired profile of the tunnel, the last-named means being responsive to the third signal by comparing therewith the limit coordinate signal in a manner to prevent movement of the winning tool beyond the desired profile of the tunnel as defined by the limit coordinate signal. In such a control system, there is further provided control means including, for example, servo valves responsive to the limit coordinate signal to carry out universal positioning of the winning tool through the control of hydraulic fluid actuators.

The present invention further provides a method for controlling the displacement of a winning tool for a tunneling machine by the steps including projecting a laser beam in a direction along a desired tunnel heading toward the tunneling machine while the winning tool thereof is arranged to work the heading face of the tunnel, generating first signals corresponding to a position change of the tunneling machine in relation to the laser beam by means including a laser detector on the tunneling machine, generating second and third signals corresponding to perpendicular position coordinates of the winning tool with respect to the tunneling machine, using the first and second signals to continuously compute a limit coordinate signal which corresponds to a measure of the distance lying perpendicularly between an intersection with one of the perpendicular position coordinates and a point on the track of movement by the winning tool when cutting the heading face at a tangent to the desired profile of the tunnel, and controlling the position of the winning tool by displacing a universally-movable support arm in response to the limit coordinate signal while comparing the third signal with the limit coordinate signal to prevent displacement of the winning tool beyond the desired profile of the tunnel.

Thus, the present invention is addressed to a control for a tunneling machine having a winning tool supported on a universally-pivotal support arm and coupled with hydraulic actuators to universally displace the winning tool through a range of movement which is limited to the desired tunnel profile in relation to a laser beam projecting along the desired heading for the tunnel. Detector means on the tunneling machine provide electrical signals which are proportional to deviations and/or offsets of the tunneling machine in relation to the laser beam for correcting the range of universal movement by the winning tool. The present invention provides that the tunneling machine further includes means such as a computer to continuously compute limit coordinates extending from the intersection of the winning tool coordinates at right angles to the measured coordinate. The computer has a mathematical program which defines the shape and size of the desired tunnel profile. By using one of the signals corresponding to a measured coordinate of the winning tool and, where appropriate, by means of any correcting signals which occur in response to deviations of the tunneling machine with respect to the laser beam, the computer provides a limit coordinate signal which defines at least one limit point to the path of motion by the winning tool so as to perform a cut at a tangent to the desired tunnel profile and along a course parallel thereto. The limit coordinate signal is compared with the remaining measured coordinate of the winning tool to prevent movement of the winning tool beyond the computed limit value. The limit coordinate signal determined by the computer in this manner always limits the pivoting motion of the support arm so that the winning tool, e.g., cutting drum, cannot move beyond the edge of the tunnel cross section into which the heading is to proceed. The tunnel cross section which is to be produced will, therefore, not only have the required shape and size but also a heading position which is defined in relation to the laser beam. This eliminates the need to employ templates and associated control mechanisms which would otherwise be required to limit the pivoting motion of the support arm. Accordingly, the construction of the control system for the tunneling machine becomes simpler, more neatly grouped and the control of the present invention is more reliable.

The features of the present invention enable the employment of a computer with a program adapted to control the pivoting motion of the support arm. The material releasing operations by the tunneling machine do not require the aid of an operator whose duties are, therefore, limited to performing required supervisory functions.

Advantageously, the winning tool is guided over the entire heading face by employing the signals produced by the computer to displace the support arm with a pivoting motion so that the arm reciprocates in a direction which is parallel to one of the axes of the coordinate system. Before the direction of movement by the support arm is reversed after each course of movement, the winning tool is guided by the computer through stepped displacements corresponding to distances that are no larger than the diameter of the winning tool and in a direction which is parallel to the desired tunnel profile. This movement of the winning tool is then followed by movement along a course of travel which is parallel but opposite to the previous course of travel by the winning tool toward the edge of the tunnel section.

The control system of the present invention, according to a further embodiment, provides that the control signals produced by the computer are employed to guide the winning tool over the heading face along courses which are successively larger but parallel to the desired tunnel profile. The winning tool is always maintained within the profile of the desired tunnel cross section which is to be worked and the winning tool is automatically moved about the heading face.

According to a further feature of the present invention, the course of travel by the winning tool, when moved along in a parallel direction to the edge of the desired tunnel profile, is divided into two components of which the component at right angles to the reciprocating motion of the winning tool or at right angles to the floor of the tunnel, is divided into predefined equal steps. The direction and magnitude of each step is associated by the computer with a displacement component which is parallel to the reciprocating motion of the winning tool or parallel to the floor of the desired tunnel profile. The winning tool is controlled to traverse simultaneously over both components of the predefined steps. By selecting a dense step sequence, i.e., a large number of small steps, the winning tool is controlled to follow along the edge of a desired tunnel profile by forming corresponding small steps in the heading face so that a practically smooth tunnel section is cut by virtue of the diameter of the winning tool which is larger in relation to the dimensions of the steps.

It is particularly desirable to move the winning tool into contact with the heading face at the approximate middle of the desired tunnel cross section and perform an initial material removing cut which is small but similar to the desired profile of the tunnel. The initial cut is then enlarged by the winning tool until the final desired dimensions of the tunnel profile are achieved. It is further desirable to perform an initial material removing cut only in the middle part of the heading wall with the winning tool close to the previously-cut edge in the heading wall. The winning tool is guided at a reduced feed rate along the edge of the heading wall to form the final cut. By employing this method of operation, detrimental vibration to accurate guiding of the winning tool is not a factor when performing the final cut to produce the desired tunnel profile. Any detrimental vibration is, therefore, confined to the inner region of the desired tunnel profile where extreme accuracy of the cut is not required. Not only are detrimental vibrations avoided by reducing the feed rate during the last cut by the winning tool but also this eliminates any noticeable deviations to the position of the winning tool and tunneling machine from the desired positions.

These features and advantages of the present invention as well as others will be more readily understood when the following description is read in light of the accompanying drawings, in which.

Figure 1:
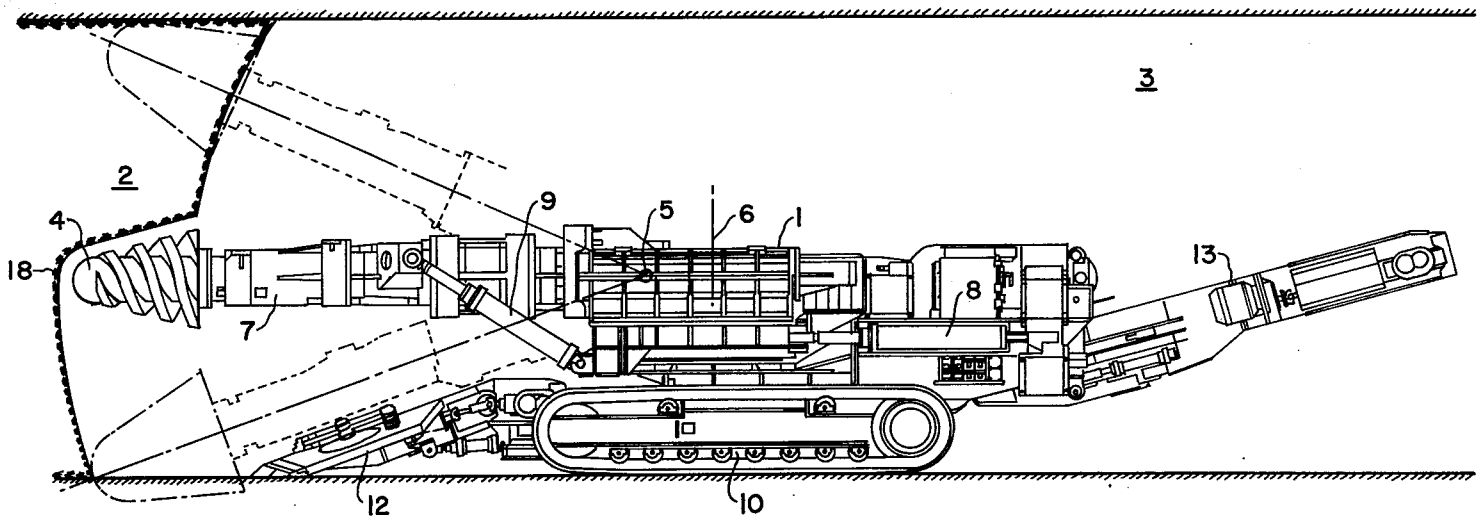
FIG. 1 is an elevational view illustrating a tunneling machine arranged to remove material from the heading face of a tunnel.
Figure 2:
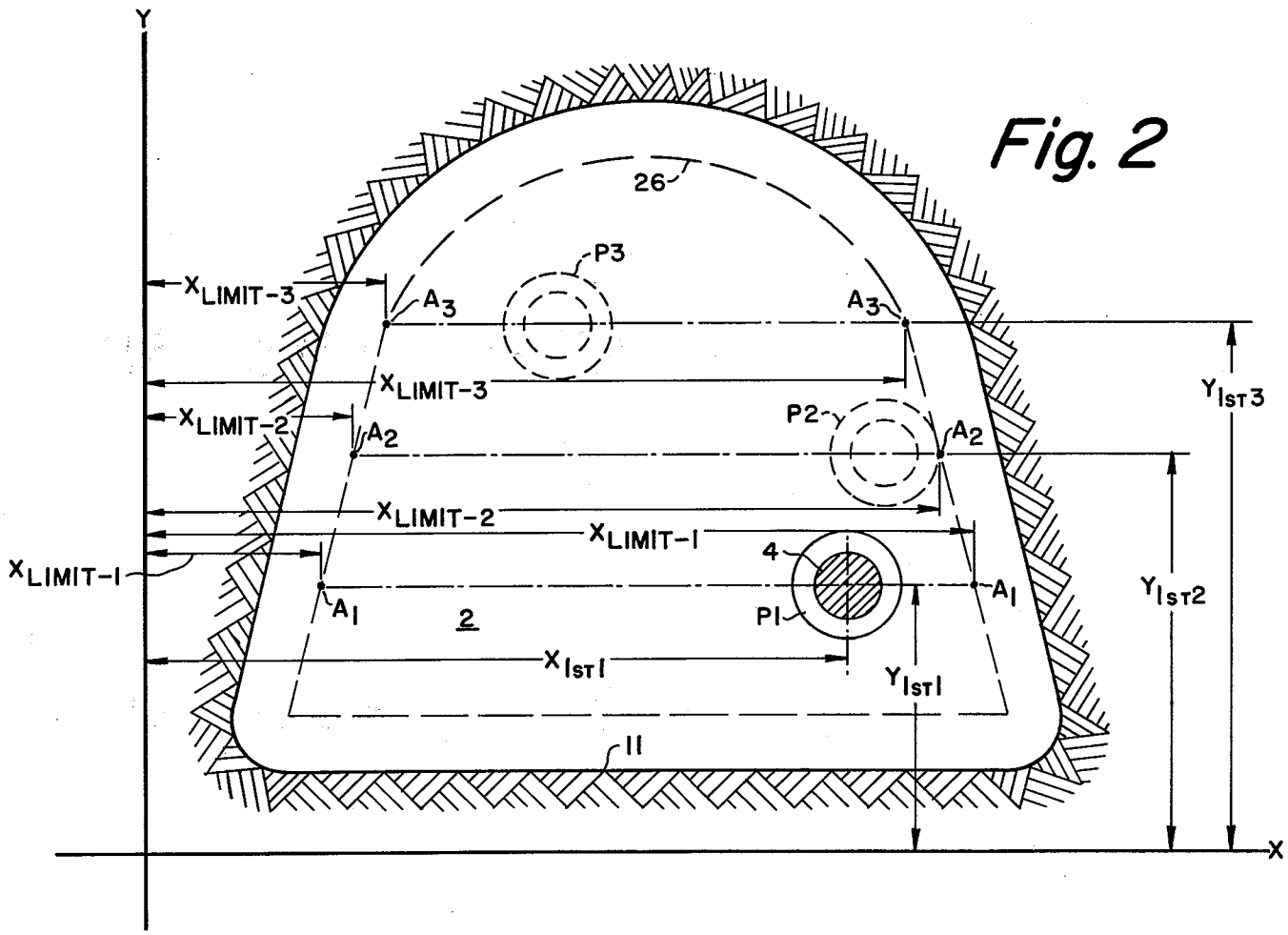
FIG. 2 is a front elevational view of a tunnel heading face and diagrammatically illustrating three positions of the winning tool according to the control of the present invention.

In FIGS. 1 and 2, there is illustrated a tunneling machine 1 adapted to release material from the heading face 2 of a tunnel 3. A cutting drum 4 forms a winning tool carried by a support arm 7 which is, in turn, supported for universal movement by the frame of the tunneling machine 1. Fluid-operated piston and cylinder assemblies 9 are provided at opposite sides of the tunneling machine to pivotally displace the support arm 7 about a horizontal axis 5. Fluid-actuated piston and cylinder assemblies 8 at opposite sides of the tunneling machine are employed to pivotally displace the support arm 7 about a vertical axis 6. Endless link belts 10 are part of catepillars used to propel the tunneling machine along the floor 11 of the tunnel. A loading shovel 12 is carried on the forward end of the tunneling machine to load the material released from the heading face for delivery at the rear of the machine by means of a conveyor 13.

A laser transmitter 14 is located on the roadway of the tunnel to project the laser beam, identified by reference numeral 15, along the desired tunnel heading toward the tunneling machine 1. The laser beam is detected on the tunneling machine by a square-shaped detector surface 16 of a laser receiver 17. The receiver is vertically and horizontally displaced on the tunneling machine by servomotors 17A and 17B, respectively, to maintain impingement of the laser beam in the center of the detector surface 16. The servomotors 17A and 17B are controlled by feedback signals from the detector surface 16 to move the receiver 17 in a manner such that the surface 16 is moved to maintain impingement by the laser beam in coincidence with the center thereof. Counters 17C and 17D provide output signals corresponding to horizontal and vertical deviations of the tunneling machine with respect to the laser beam. These output signals are proportional to the displacements of the receiver which are required to align the center of detector surface 16 with the laser beam. Thus, the electrical signals produced by counters 17C and 17D correspond to vertical and horizontal deviations of the tunneling machine 1 from its initial or set-point position.

Angular deviations of the tunneling machine with respect to the laser beam 15 and/or rotational deviation of the tunneling machine about its longitudinal axis 18 are detected by means of, for example, two gyroscopes arranged within a gyroscope detector 19. One of the gyroscopes has a wheelspin axis extending horizontally in the cross-sectional plane of the tunnel 3 and the other gyroscope has a wheelspin axis extending vertically with the cross-sectional plane of the tunnel 3. Detectors for the two gyroscopes provide output signals corresponding to angular and rotational deviations to the positions of the tunneling machine. Thus, the detector surface 16 of the receiver 17 detects all horizontal and vertical deviations of the tunneling machine 1 with respect to the laser beam while angular deivations, i.e., inclined positions of the tunneling machine with respect to the laser beam and offsets, i.e., rotational twisting of the tunneling machine about its longitudinal axis 18 are detected by the two gyroscopes in casing 19.

The deivation signals produced by the counters 17C and 17D as well as the signals produced by the two gyroscopes in casing 19 are fed to a computer 20. All data for the desired tunnel profile to be formed in the heading face 2 is constantly supplied from a store 21 to the computer 20. The computer receives other electrical signals which are proportional to measured position coordinates of the cutting drum 4. To provide these signals, the pivot shafts forming the pivot axes 5 and 6 are separately coupled to angular motion transducers such as pulse transmitters 22 and 23, respectively. Pivotal movement by the support arm 7 is detected by transmitters 22 and 23. The outputs from these transmitters are in the form of electrical pulses which are directly proportional to the magnitude of the displacement angle of the support arm. The counters 24 and 25 convert the pulse outputs from transmitters 22 and 23 into analog signals which are proportional to the coordinates of the winning tool and will be designated for the purpose of this description as measured coordinate signals $Y_1$ and $X_1$, respectively.

The $Y_1$ measured coordinate signal fed into the computer commands delivery of a desired tunnel profile program from the store 21 into the computer 20 for computing the associated limit coordinate $X_{Limit}$. For example, as illustrated in FIG. 2, if the coordinate $Y_{1st1}$ is fed by counter 25 into the computer 20, there will be defined two opposite points $A_1$ on the track 26 by two coordinates $X_{Limit-1}$. The track 26 extends within the desired tunnel profile along a course which is parallel thereto at a distance spaced from the actual desired tunnel outline by an amount corresponding to the diameter of the cutting tool. The coordinates $X_{Limit-1}$ prevent movement of the cutting tool beyond the two points $A_1$ in the direction toward the edge of the desired tunnel profile. If the position of the cutting drum 4 is altered and, therefore, the Y coordinate, then the limit values of $X_{Limit}$ as defined by the computer will also be instantly altered by the computer. If the position of the cutting drum changes from position P1 to position P2 or P3, then the $X_{Limit}$ coordinates will change together with the measured coordinate signal $Y_{1st2}$ or $Y_{1st3}$. The two $X_{Limit}$ coordinates will assume the magnitude $X_{Limit-2}$ or $X_{Limit-3}$ through which the two points $A_2$ or the two points $A_3$, respectively, lie on the track 26. The $Y_1$ coordinate of the cutting drum 4 is also constantly monitored by the computer to prevent a lowering of the winning tool below the floor level of the desired tunnel outline as well as to prevent raising of the winning tool above the roof of a desired tunnel profile during the material removing operation.

When the counter 20 is switched ON, the operator may pivot the support arm 7 as desired within the desired profile along the heading face 2. However, the operator cannot displace the cutting drum beyond the edge of the desired tunnel profile provided that the tunneling machine remains at a set-point position. Deviations of the tunneling machine from the set-point position do not impair the accuracy at which material is removed from the heading face because the computer equalizes such deviations by employing the correcting signals detected and supplied by using receiver 17 and the gyroscopes in casing 19 when the limit values are determined.

Figure 3:
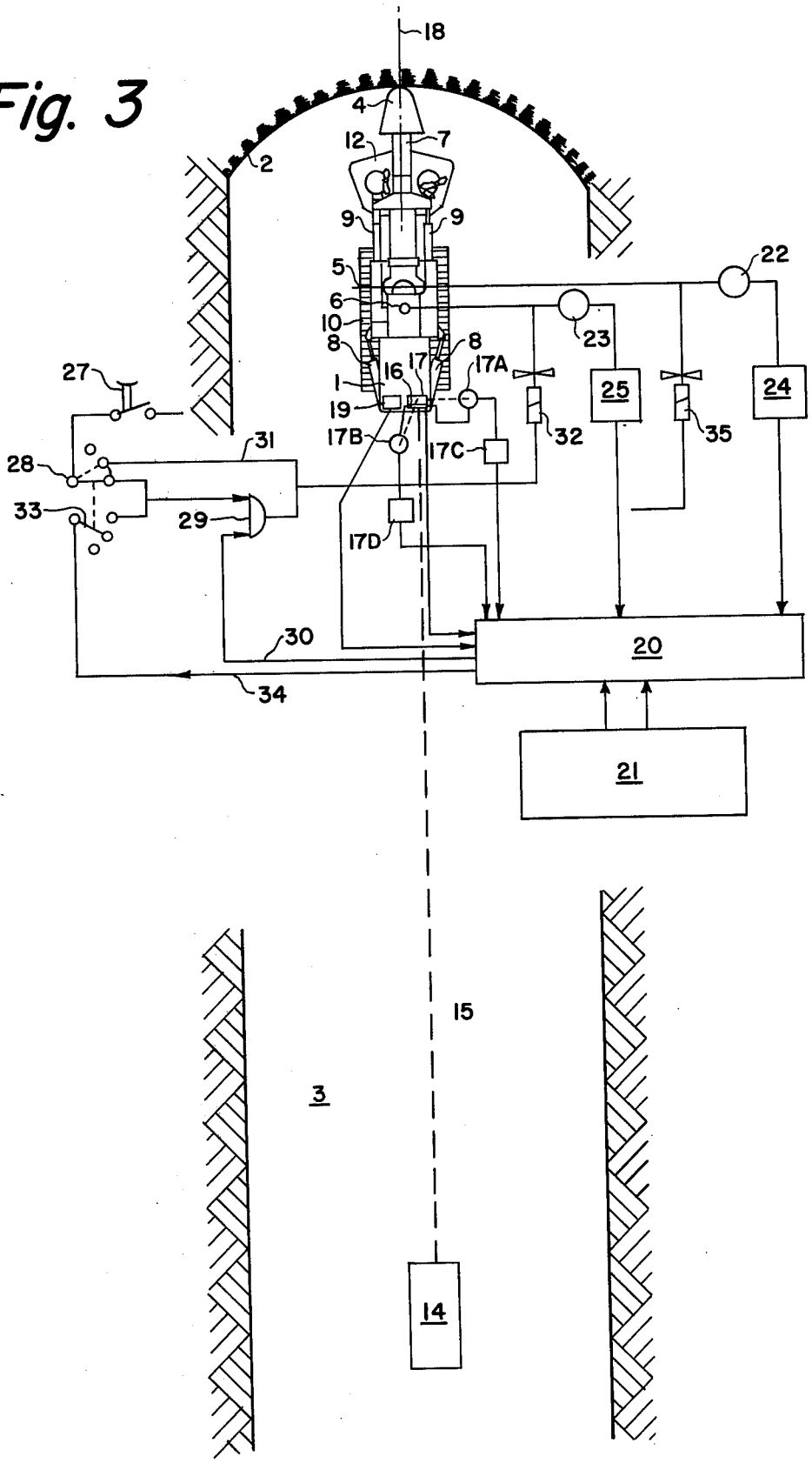
FIG. 3 is a plan view of the tunneling machine shown in FIG. 1 together with a control system according to the present invention.

FIG. 3 illustrates a manual control switch 27 used to produce a signal for horizontal movement of the support arm 7. The control signal produced by the manual control switch 27 passes through a selector switch 28 to an AND circuit 29 which receives a second input over line 30 which is the control signal output from the computer. When the selector switch 28 is in the dashed-line position, the signal from the manual control switch 27 is fed by line 31 directly to an electrohydraulic control 32, e.g., a servo valve which, in turn, controls the operation of the piston and cylinder assemblies 8. The control signal output from the computer 20 is not utilized when the selector switch 28 is in the dash-line position since the output of the manual control switch 27 passes directly via line 31 to the electrohydraulic control 32 and, therefore, the pivoting motion of the support arm is not limited by the control signal output in line 30 from the computer. This enables an operator of the tunneling machine to displace the winning tool 4 beyond the edge of the desired tunnel profile when necessary.

The control signal produced by the manual control switch 27 is passed to the AND circuit 29 when the selector switch 28 is in the position shown by solid lines in FIG. 3. So long as there is a difference between the limit value and the measured value of the winning tool coordinates, i.e., of the abscissae, the AND circuit 29 receives an output signal from the computer 20 as well as a control signal from the manual control switch 27. The AND circuit 29 is, therefore, rendered conductive for the signal from the manual control switch 27 whereby the winning tool 4 may be moved manually within the desired profile of the tunnel. However, in the absence of an output signal from the computer 20, which occurs when the limit value and the measured value are equal, the AND circuit 29 is rendered nonconductive, thus preventing displacement of the winning tool beyond the edge of the desired tunnel profile. It is, therefore, clear that the AND circuit is employed according to the present invention to prevent displacement of the support arm of the tunneling machine beyond the edge of the desired profile of the tunnel but, at the same time, the support arm is controllable to pivot back into the region of the desired profile of the tunnel. The computer output is also connected via line 34 to the AND circuit 29 through a selector switch 33 which is mechanically coupled to the selector switch 28. The selector switch 33 conducts the output signal from the computer to the AND circuit 29 when the selector switch 28 is not connected thereto, and vice versa. The immediately preceding description has been directed to the control circuit shown in FIG. 3 for providing a signal used by the electrohydraulic control 32 for moving the support arm 7 about axis 6. An essentially duplicate form of control system is required for operating an elecrohydraulic control 35, i.e., servo valve, to bring about vertical displacements of the cutting drum 4 about the pivot axis 5. In this regard, it is deemed sufficient for purposes of understanding the present invention by those skilled in the art to point out that a manual control similar to switch 27, selector switches 28 and 33 and an AND circuit 29 is used, in the same manner already described, to carry out the vertical displacements of the cutting drum 4. It is to be understood that, if desired, the electrohydraulic control 35 may be controlled solely in response to the output from the computer 20.

As described previously, deviations of the tunneling machine as well as data supplied from the store 21 are used by the computer 20 to compute limit values to form a tunnel having a desired profile in the direction of the desired heading. The data supplied by the store 21 comprises the mathematical funtion which defines the desired tunnel profile or the mathematical functions of individual tunnel profile sections and the profile radii R which define the profile dimensions and the coordinates of the centers M for the radii R identified in FIG. 4. The store 21 also delivers to the computer a program to carry out the actual material releasing operation and the path or course of travel by the cutting drum 4 along the heading face. The control signals produced by the computer with the aid of the program and any correcting signals which may occur are applied to the input of the AND circuit 29 when selector switch 33 is engaged. These signals are fed to the electrohydraulic control 32 so long as the AND circuit 29 is simultaneously supplied with a signal from computer 20 to correspond to the deviations between the limit value and the measured value. The winning tool is, therefore, guided along the heading face with a specific rhythm. In this event, the operator of the tunneling machine performs merely a supervisory function.

Figure 4:
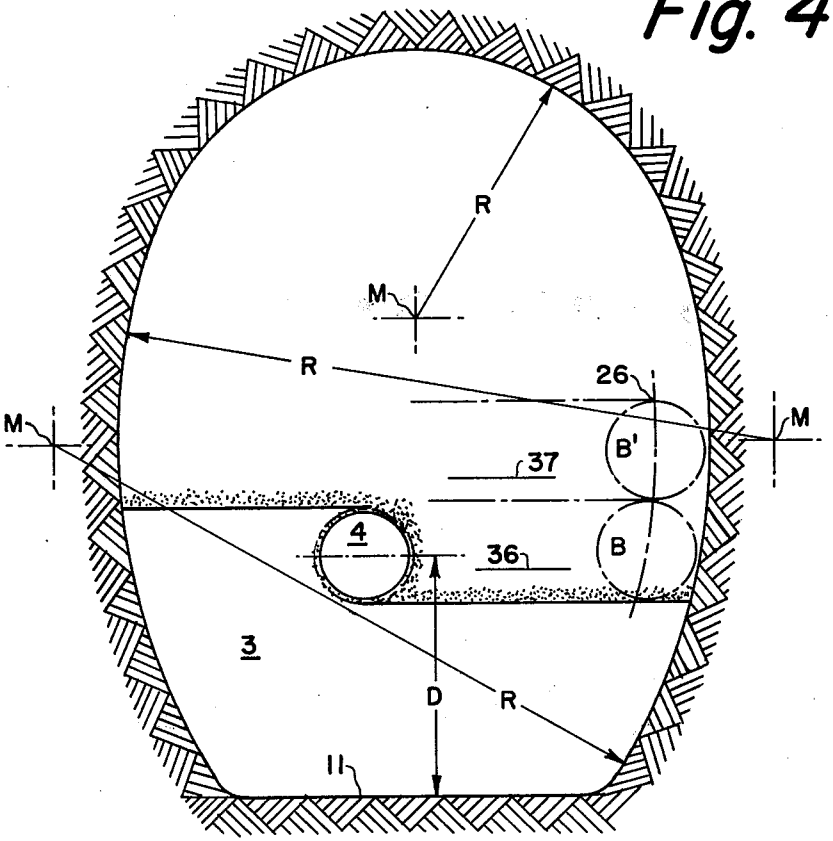
FIG. 4 is view similar to FIG. 2 and illustrating reciprocating courses of travel by the winning tool to produce a tunnel having a desired profile.

Turning, now, specifically to FIG. 4, the cutting drum 4 is guided over the heading face 2 through the use of the program supplied to the computer by the store 21 by the computer 20 along reciprocating steps that are parallel to the floor 11 of the tunnel in the directions indicated by the arrows 36 and 37. In this embodiment, the floor of the tunnel coincides with the X-axis of a coordinate system and the Y signal is a measured signal proportional to the distance G between the horizontal plane of movement by the support arm 7 and the floor 11. The associated function values of the tunnel profile and the profile data which define the desired profile dimensions for the tunnel on which the heading operation to be carried out are called up from the store 21 by the computer 20 with the aid of the aforementioned measured signal. Depending upon the direction of motion by the support arm 7, the computer 20 forms an output signal by using the signals from the store and any machine deviation signals which may occur as detected by the two gyroscopes and/or by the receiver 17. The output signal from the computer is applied as a limit value to the AND circuit 29. The limit value signal defines the end point of horizontal motion by the support arm along the appropriate direction of motion.

When the support arm 7 reaches its final position as defined by the limit value, the cutting drum 4 is situated at the edge of the desired tunnel cross section which is to be formed, namely, at position B shown in FIG. 4. In this position, the measured value, i.e., output from counter 25, will have become equal to the limit value which is determined by the computer. In this situation, the AND circuit 29 is rendered non-conductive whereby there is an absence of a signal to the electrohydraulic control 32 and, therefore, further pivoting motion of the support arm 7 is prohibited which would otherwise move the winning tool beyond the desired tunnel profile. An output signal is then triggered in the computer by the program in store 21. This output signal is supplied to the circuit parts which deliver a control signal to the electrohydraulic control 35 whereby the support arm 7 is raised by the piston and cylinder assemblies 9 until the measured value as detected by the pulse transmitter 22 about the pivoting axis 5 corresponds to the set-point value as required by the output of the computer vertically raises the cutting drum 4 to position B′ and by an amount that does not exceed the diameter of the cutting drum.

This motion of the cutting drum is subdivided into predetermined individual steps, for example, 1 centimeter in magnitude, and this motion is continuously monitored in the computer 20. In other words, the computer 20 determines the two vertically-spaced points along track 26 situated in the appropriate horizontal planes after the durm moves by the distance of a subdivided step. The position of the cutting drum in each individual horizontal stepping plane is constantly corrected by means of deviations between the limit value and measured value signals. The deivations render the AND circuit 29 conductive for signals from the computer output so as to guide the cutting drum along the edge of the desired tunnel profile until the drum reaches its new horizontal working plane which is the position designated B′ in FIG. 4. Thus, when sections to be removed from the heading wall are not coextensive with respect to each other, the cutting drum is moved by the support arm simultaneously with a horizontal and vertical motion as it proceeds from each stepped plane. The horizontal motion is superimposed on a continuous vertical motion so that there is no noticeable step formed in the edge of the desired tunnel profile. This is because the diameter of the cutting drum is very large in relation to the dimension of the stepped movement thereof.

The program in the store defines the height of the vertical step by the drum. At the end of each vertical step, the computer initiates a control signal for horizontal support arm motion in the direction of arrow 37 whereby the cutting drum follows a course of travel opposite the course of travel followed in the direction of arrow 36 and along the entire width of the heading face 2. In this way, material is removed from the entire heading face 2 in the form of horizontal strips. The support arm 7 is automatically returned into its starting position after the cutting drum 4 has formed the roof of the tunnel. The starting position of the cutting drum, in this case, is the position of the support arm 7 at which the cutting drum is driven into the heading face 2. This can be a position in which the cutting drum 4 penetrates into the heading face at a corner of the desired tunnel profile at the plane of the floor 11. It is also possible to drive the cutting drum into the middle of the heading face when the support arm is in the horizontal position whereby this position is then designated as the starting position. In this case, the initial cut is enlarged in the horizontal direction to the edge of the desired tunnel profile and thereafter in a manner described hereinabove whereby material is removed from the heading face in the form of horizontal strips from the roof down to the floor depending upon whether the material was first removed from the top or bottom part of the heading face 2.

Figure 5:
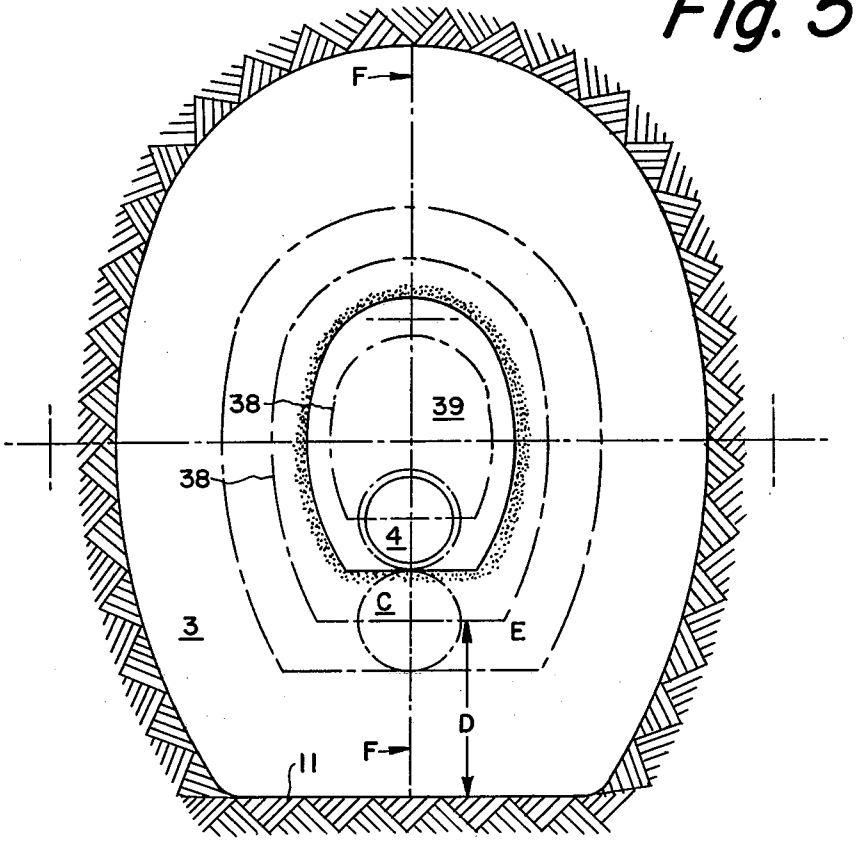
FIG. 5 is a view similar to FIG. 4 and illustrating different courses of travel for the winning tool by employing the control system of the present invention.

FIG. 5 illustrates a different mode of cutting operation to release material from the heading face 2 by employing the control system according to the present invention. The cuting drum 4 is guided about the heading face 2 along courses of travel or tracks 38 which are parallel to the desired tunnel profile. The cut 39 is the initial cut made in the center or middle of the tunnel profile. The cutting drum is then guided in a manner to enlarge the initial cut until the desired tunnel profile is formed. The cutting drum is displaced continually along one circular course of travel as shown in FIG. 5 within the cut 39 to a starting point which is directly below the initial cut. From this position, the drum is lowered by a distance which does not exceed the diameter of the drum into position C before the next cut is made during which the center of the drum moves along a course indicated by track 38′. These individual steps for removing material from the heading face are repeated until the desired tunnel profile is formed. This mode of operation for removing material from the heading face is also performed by employing the program in store 21. During the material removing operation, the position of the cutting drum is controlled by the computer 20 which is continually supplied with electrical signals to indicate all changes to the position of the tunneling machine which occur. The computer continually employs the data representing the desired tunnel cross section.

As illustrated in FIG. 5, an end point E of cutter travel is determined by the computer 20 whereby the motion of the cutting drum is parallel to the floor 11 and the desired tunnel profile by means of the stored program, the profile data, any tunneling machine deviations which may be present, and by the measured coordinate provided by the signal from transmitter 22. The measured value of the signal from transmitter 22 is proportional, in this embodiment, to the distance D between the middle of the cutting drum and the floor 11. This signal renders the AND circuit 29 conductive by a corresponding limit signal which defines the limits to the horizontal motion by the cutting drum. The horizontal motion of the support arm ceases when the limit signal is equal to the value of the measured signal. The working program of the store 21 forms the means by which the computer then initiates a lifting motion of the cutting drum 4 which, in this case, is also divided into small vertical steps of approximately 1 centimeter in length. The arcuate shape of the tunnel profile is accommodated by allocating to each of the steps a newly-determined limit signal which proceeds from the vertical plane of symmetry FF of the tunnel profile. This newly-determined limit signal is delivered to the AND circuit 29, rendering it conductive, and this signal is also compared by the computer 20 with the measured signal which is fed into the computer. An equalization between the $X_{Limit}$ signal and the measured X signal corrects the position of the drum in the appropriate horizontal plane so that the cutting drum 4 moves under a simultaneous influence of a lifting motion along course 38′ which is parallel to the desired tunnel profile. When the cutting drum reaches the roof or the highest position when enlarging the initial cut 39, the computer reverses the direction of motion by the support arm according to the stored program whereby the lifting motion of the drum 4 changes into a lowering motion which is also divided into individual steps in which the X position of the drum is corrected. The lowering motion of the drum ceases as soon as the cutting drum 4 reaches a level determined according to the program in the store. The motion of the cutting drum is then changed into a horizontal motion parallel to the floor during which motion the cutting drum is returned to its starting position C illustrated in FIG. 5. When the lowering motion is again commenced, the displacement of the drum will not exceed the diameter of the drum which displacement is defined by the computer and fixed by the program in the store 21. The diameter of the drum is defined when the program is set and by reference to the desired tunnel profile which is to be cut in the heading face. The distance through which the cutting drum is lowered can be set so that the movement of the drum when cutting toward the floor 11 or toward the roof during each course of travel produces a greater width of cut than when cutting toward the vertical sides of the tunnel. This insures that the cutting drum remains in engagement with the last-to-be cut edge in the heading face so that the cutting drum does not idly circulate about a course of travel. It is preferred to reduce the feed rate during the last cut in the heading face during which the precise tunnel profile is formed. This will reduce vibrations of the tunneling machine and thereby increase the accuracy at which the desired profile of a tunnel is formed.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A control system for controlling displacement of a winning tool by a support arm adapted for universal movement while supported by the frame of a tunneling machine employed to form a tunnel with a desired profile, said control system including the combination of:

means for projecting a laser beam in a direction along a desired tunnel heading toward said tunneling machine while the winning tool thereof is arranged to release material from the heading face of a tunnel, means including a laser beam detector on the tunneling machine for generating first electrical signals corresponding to a position change of said tunneling machine with respect to said laser beam, means for generating second and third electrical signals corresponding to perpendicular position coordinates of said winning tool with respect to said tunneling machine, means responsive to said first and second electrical signals to continuously compute a limit coordinate signal which corresponds to a measure of the distance lying perpendicularly between an intersection with the winning tool as defined by an intersection with one of said two perpendicular position coordinates and a point on the track of movement by the winning tool when cutting the heading face at a tangent to the desired profile of the tunnel, said last-named means being responsive to said third electrical signal by comparing therewith said limit coordinate signal in a manner to prevent movement of the winning tool beyond the desired profile of the tunnel as defined by said limit coordinate signal, and control means responsive to said limit coordinate signal for universal positioning of said winning tool to form a desired tunnel profile.

2. A method for controlling the displacement of a winning tool by a support arm adapted for universal movement while supported by the frame of a tunneling machine employed to release material from a heading face and form a tunnel having a desired profile, said method including the steps of:

projecting a laser beam in a direction along the desired tunnel heading toward said tunneling machine while the winning tool thereof is arranged to work the heading face of the tunnel, generating first electrical signals corresponding to a position change of the tunneling machine in relation to the laser beam by means including a laser detector on the tunneling machine, generating second and third electrical signals corresponding to perpendicular position coordinates of the winning tool with respect to the tunneling machine, using said first and second electrical signals to continuously compute a limit coordinate control signal which corresponds to a measure of the distance lying perpendicularly between an intersection with one of said two perpendicular position coordinates and a point on the track of movement by the winning tool when cutting the heading face at a tangent to the desired profile of the tunnel, and controlling the position of the winning tool by displacing said support arm in response to said limit coordinate control signal while comparing said third electrical signal with said limit coordinate control signal to prevent displacement of the winning tool beyond the desired profile of the tunnel.

3. The method according to claim 2 wherein said controlling the position of the winning tool includes the steps of displacing said winning tool in a direction which is parallel to one axis of an X-Y coordinate system, indexing the winning tool through a distance which does not exceed the width of cut by the winning tool in a perpendicular direction to the direction of displacement during said step of displacing, said winning tool being indexed in a direction forming a tangent with the desired tunnel profile, and thereafter displacing the winning tool in an opposite and parallel direction of displacement by the first-mentioned step of displacing.

4. The method according to claim 2 wherein said controlling the position of the winning tool includes the step of displacing the winning tool along successive courses of travel which are parallel to the desired profile of the tunnel.

5. The method according to claim 2 wherein said step of using said first and second electrical signals includes computing two desired and perpendicular displacement components from the detected path of displacement of the winning tool for displacing the winning tool along a course which is parallel with the desired profile of the tunnel, said step of using said first and second electrical signals further including subdividing the desired displacement component which is perpendicular to said detected path of displacement into equal parts each having a preselected magnitude, and wherein said step of controlling includes indexing the winning tool along a course parallel with the desired tunnel profile by a winning tool displacement that simultaneously corresponds to the sum of the subdivided equal parts of one as well as the other of said two desired and perpendicular displacement components.

6. The method according to claim 2 wherein said step of using said first and second electrical signals includes computing two desired and perpendicular displacement components from the detected path of displacement of the winning tool for displacing the winning tool along a course which is parallel with the desired profile of the tunnel, said step of using said first and second electrical signals further including subdividing the desired displacement components of said two desired and perpendicular displacement components which is perpendicular to the tunnel roadway into equal parts each having a preselected magnitude, and wherein said step of controlling includes indexing the winning tool along a course parallel with the desired tunnel profile by a winning tool displacement that simultaneously corresponds to the sum of the subdivided equal parts of one as well as the other of said two desired and perpendicular displacement components.

7. The method according to claim 2 wherein said step of controlling the position of the winning tool includes displacing said support arm along a course of travel corresponding to and lying approximately in the middle of the desired tunnel profile whereby material is cut from the heading wall by displacing the winning tool along an enlarged course of travel to the last-mentioned course of travel to form a desired profile of the tunnel.

8. The method according to claim 2 wherein said step of controlling the position of the winning tool includes reducing the rate of displacement of the winning tool while releasing material from the heading wall during movement along the outer edge of the desired tunnel profile.

* * * * *